US009776834B2

(12) United States Patent
Noshita

(10) Patent No.: US 9,776,834 B2
(45) Date of Patent: Oct. 3, 2017

(54) BALUSTRADE DEVICE FOR PASSENGER CONVEYOR

(71) Applicant: MITSUBISHI ELECTRIC CORPORATION, Chiyoda-ku (JP)

(72) Inventor: Akira Noshita, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 0 days.

(21) Appl. No.: 15/521,672

(22) PCT Filed: Jan. 29, 2015

(86) PCT No.: PCT/JP2015/052543

§ 371 (c)(1),
(2) Date: Apr. 25, 2017

(87) PCT Pub. No.: WO2016/121056

PCT Pub. Date: Aug. 4, 2016

(65) Prior Publication Data

US 2017/0240386 A1 Aug. 24, 2017

(51) Int. Cl.
*B66B 23/22* (2006.01)
*B66B 23/24* (2006.01)

(52) U.S. Cl.
CPC ..... *B66B 23/22* (2013.01)

(58) Field of Classification Search
CPC ..... B66B 23/22; B66B 23/24
USPC ..... 198/335–338
See application file for complete search history.

(56) References Cited

U.S. PATENT DOCUMENTS 4,159,758 A * 7/1979 Courson ..... B66B 23/22 198/335
4,488,631 A * 12/1984 Courson ..... B66B 23/22 198/335
4,819,781 A * 4/1989 Saito ..... B66B 23/22 198/335
4,889,222 A 12/1989 Kanamori
(Continued)

FOREIGN PATENT DOCUMENTS

JP 57-72588 A 5/1982
JP 61-174089 A 8/1986
JP 62-2231 Y2 1/1987

OTHER PUBLICATIONS

International Search Report dated Apr. 28, 2015, in PCT/JP2015/052543, filed Jan. 29, 2015.

*Primary Examiner* — Douglas Hess
(74) *Attorney, Agent, or Firm* — Oblon, McClelland, Maier & Neustadt, L.L.P.

(57) ABSTRACT

A balustrade device for a passenger conveyor, wherein a plurality of balustrade posts are erected at intervals apart in a direction of travel of steps. A plurality of outer decks abut against each other at positions of the balustrade posts. Recesses, through which the balustrade posts are passed respectively, are provided in the mutually adjacent end portions of the outer decks. Gaps are provided respectively between edges of the recesses and the balustrade posts. A plurality of cover members which close the gaps are provided on top of the outer decks. Each of the cover members is fixed to the balustrade post via a retainer which is fixed to an end surface of the balustrade post on a side of the step.

6 Claims, 13 Drawing Sheets

(56) References Cited

U.S. PATENT DOCUMENTS

| | | | | | |
|---|---|---|---|---|---|
| 4,953,686 | A | * | 9/1990 | Rulke | B66B 23/225 198/326 |
| 5,029,690 | A | * | 7/1991 | Nguyen | B66B 23/22 198/335 |
| 5,040,659 | A | * | 8/1991 | Saito | B66B 31/00 198/324 |
| 5,156,251 | A | * | 10/1992 | Johnson | B66B 23/22 198/335 |
| 5,186,302 | A | * | 2/1993 | Johnson | B66B 23/22 198/335 |
| 5,215,177 | A | * | 6/1993 | Johnson | B66B 23/22 198/335 |
| 5,421,076 | A | * | 6/1995 | Adrian | B66B 23/22 29/467 |
| 5,542,522 | A | * | 8/1996 | Adrian | B66B 23/22 198/337 |
| 5,601,179 | A | * | 2/1997 | Wente | B66B 23/22 198/335 |
| 6,082,520 | A | * | 7/2000 | Kleewein | B66B 23/225 198/324 |
| 6,533,098 | B1 | * | 3/2003 | Winkler | B66B 23/22 198/321 |
| 8,123,020 | B2 | * | 2/2012 | Fang | B66B 23/22 198/335 |
| 9,193,569 | B2 | * | 11/2015 | Shimizu | B66B 23/22 |
| 9,676,597 | B2 | * | 6/2017 | Senger | B66B 23/00 |

* cited by examiner

BALUSTRADE DEVICE FOR PASSENGER CONVEYOR

TECHNICAL FIELD

This invention relates to a balustrade device for a passenger conveyor wherein a plurality of outer decks are arranged in line with a direction of travel of steps and abut against each other at the positions of balustrade posts.

BACKGROUND ART

In a conventional balustrade device for an escalator, a plurality of outer decks are arranged in line with a direction of travel of steps and abut against each other at the positions of balustrade posts. Each balustrade post passes through a notch provided in the outer decks. The longitudinal-direction dimension of the outer decks allows a margin with respect the dimension of the balustrade posts in the same direction. Covers which close the gaps between the balustrade posts and the outer decks are provided on top of the outer decks (see PTL 1, for example).

CITATION LIST

Patent Literature

[PTL 1] Japanese Examined Utility Model Application Publication No. S62-2231

SUMMARY OF THE INVENTION

Problem to be Solved by the Invention

In a conventional balustrade device such as that described above, the covers are each constituted by a cover main body, a pressing plate disposed on the rear side of the cover main body, and an interval piece which is interposed between the cover main body and the pressing plate, and therefore the configuration of the cover is complicated. In particular, in a spiral escalator in which the path of the steps as viewed from directly above is curved in an arc shape, it is difficult to hold the balustrade panels by glass alone and it is necessary to dispose a plurality of balustrade posts which are strengthening members. Consequently, the number of covers increases and it is desirable to simplify the configuration of the cover.

Furthermore, in a conventional balustrade device, when installing the outer decks, it is necessary to sandwich the covers between the balustrade posts and the outer decks, and there is a problem in that shaking is liable to occur in the covers due to manufacturing errors in the opening dimensions of the outer decks and the covers. Moreover, if an outer deck is mistakenly installed without attaching a cover, then it is necessary to remove the outer deck and install the outer deck again, and there is also the burden of having to install the outer decks while sandwiching the cover between the balustrade post and the outer deck.

This invention was devised in order to solve the above-mentioned problem, an object thereof being to provide a balustrade device for a passenger conveyor wherein the structure of cover members can be simplified, and furthermore, the cover members can be attached without any shaking thereof and the cover members can be attached after installation of outer decks.

Means for Solving the Problem

The balustrade device for a passenger conveyor according to this invention includes: a plurality of balustrade posts which are erected at intervals apart in a direction of travel of steps; and a plurality of outer decks which are arranged in line with the direction of travel of the steps and abut against each other at the positions of the balustrade posts; recesses, through which the balustrade posts are passed respectively, are provided in the mutually adjacent end portions of the outer decks; gaps are provided respectively between edges of the recesses and the balustrade posts; a plurality of cover members which close the gaps are provided on top of the outer decks; and each of the cover members is fixed to the balustrade post via a retainer which is fixed to an end surface of the balustrade post on a side of the step.

Effects of the Invention

In the balustrade device for a passenger conveyor according to this invention, since the cover members are fixed to the balustrade posts via retainers which are fixed to the step-side end surfaces of the balustrade posts, then it is possible to simplify the structure of the cover members, and furthermore, the cover members can be attached without any shaking thereof and the cover members can be attached after installation of the outer decks.

DESCRIPTION OF EMBODIMENTS

Below, embodiments of this invention are described with reference to the drawings.

First Embodiment

Figure 1:
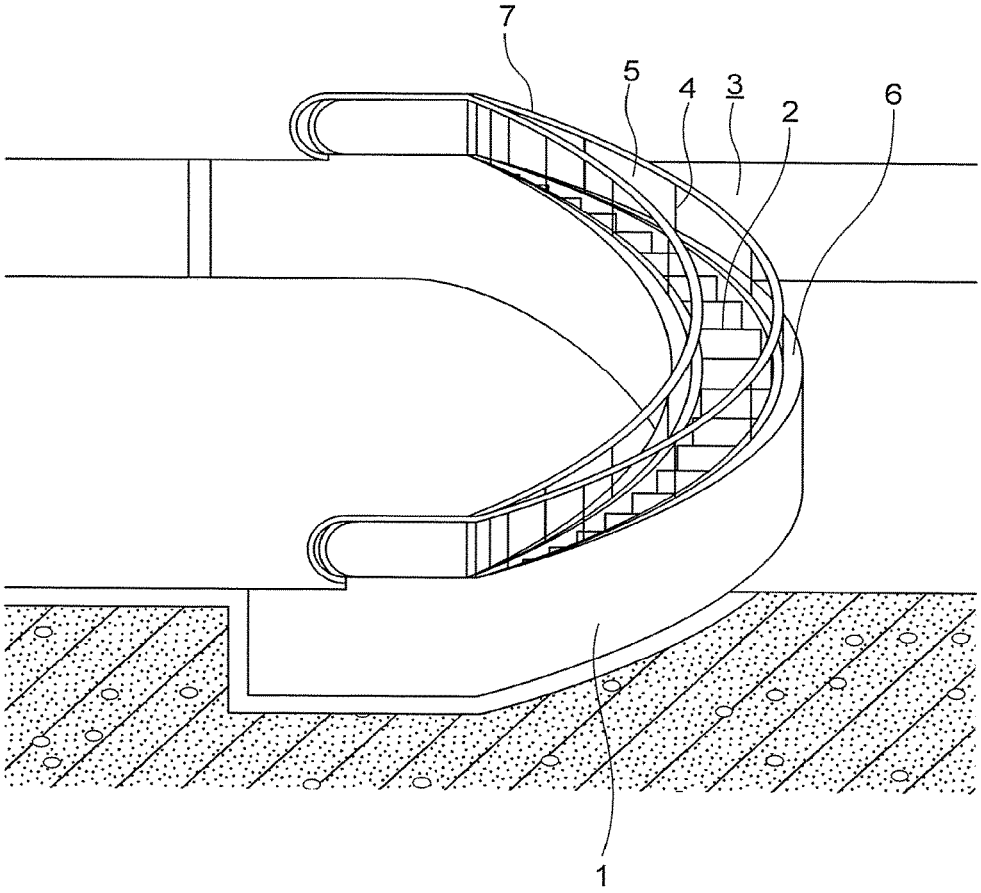
FIG. 1 is a front surface diagram showing a spiral escalator according to a first embodiment of this invention.

FIG. 1 is a front surface diagram showing a spiral escalator according to a first embodiment of this invention. In FIG. 1, a plurality of steps 2 which are coupled endlessly are supported on a main frame 1. The steps 2 circulate and move along a path which is curved in a circular arc shaped viewed from directly above (a path having a shape which is a portion of a spiral).

A pair of balustrade devices 3 are provided on both sides of the steps 2 on the main frame 1. The balustrade devices 3 each have a plurality of balustrade posts 4 having a square bar shape, a plurality of transparent balustrade panels 5 which are curved along the direction of travel of the steps 2, a plurality of flat plate-shaped outer decks 6 which are disposed in a slightly curving fashion, and an endless moving handrail 7 which moves and circulates in synchronism with the steps 2.

The balustrade posts 4 are erected vertically on the main frame 1, at intervals apart from each other in the direction of travel of the steps 2. The balustrade panels 5 are arranged in line with the direction of travel of the steps 2. Furthermore, the balustrade panels 5 are arranged on the side of the steps 2 with respect to the balustrade posts 4. The outer decks 6 are arranged below and to the outside of the balustrade panel 5 as viewed from the side of the steps 2.

Figure 2:
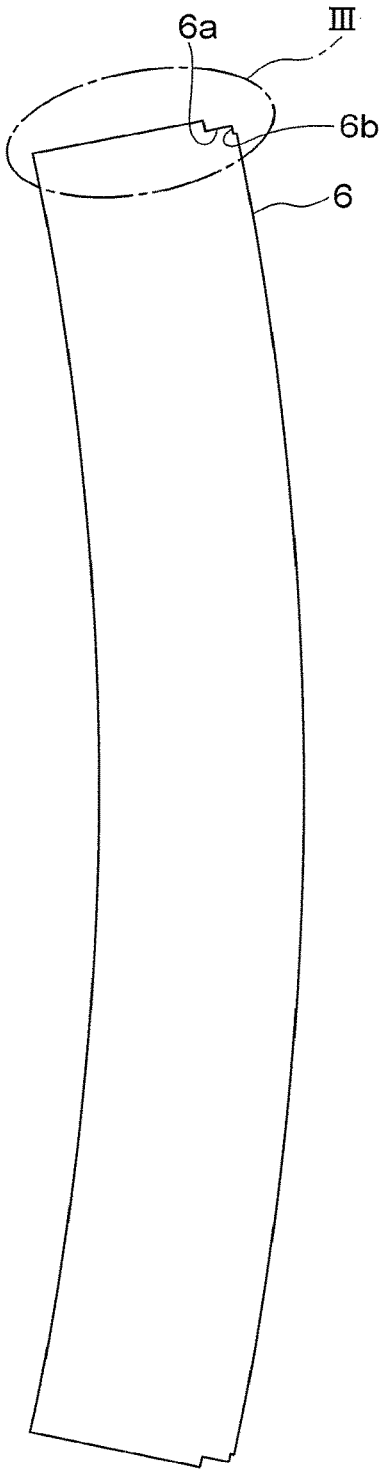
FIG. 2 is a plan diagram illustrating one of the outer decks in FIG. 1.
Figure 3:
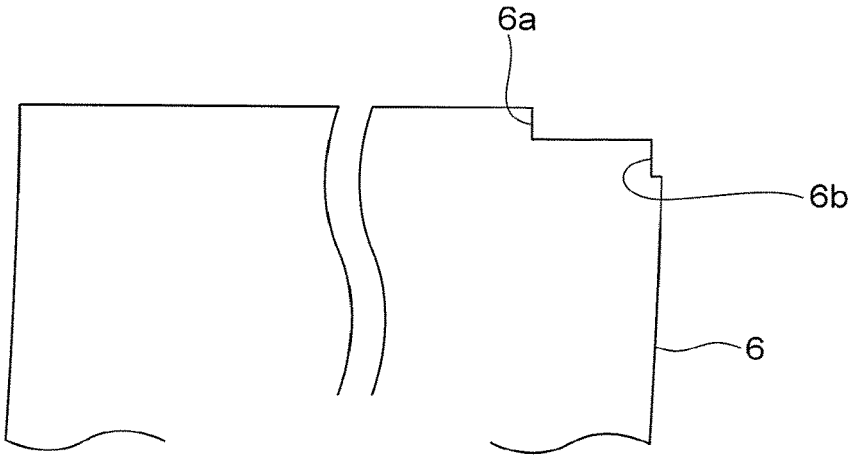
FIG. 3 is a cross-sectional diagram showing an enlarged view of portion III in FIG. 2.

FIG. 2 is a plan view diagram showing one of the outer decks 6 in FIG. 1, and FIG. 3 is a plan view diagram showing an enlarged view of portion III of FIG. 2. The outer decks 6 are arranged in line with the direction of travel of the steps 2, and abut against each other at the positions of the balustrade posts 4. A balustrade post notch 6*a* and a cover notch 6*b* are provided on the step 2-side edge of each of the outer deck 16 at both ends thereof in the longitudinal direction.

Figure 4:
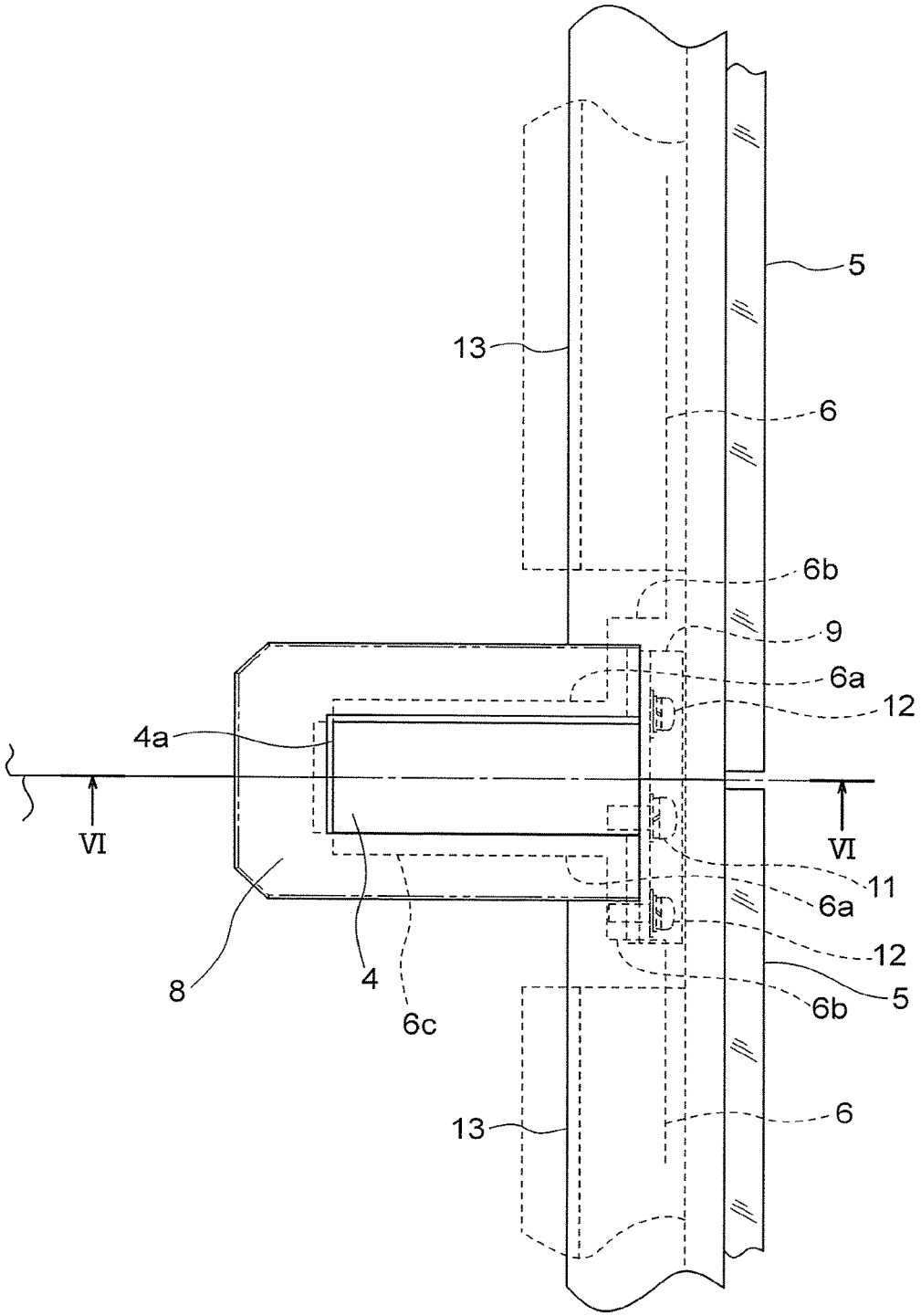
FIG. 4 is a plan diagram illustrating a joint of the outer decks in FIG. 1.
Figure 5:
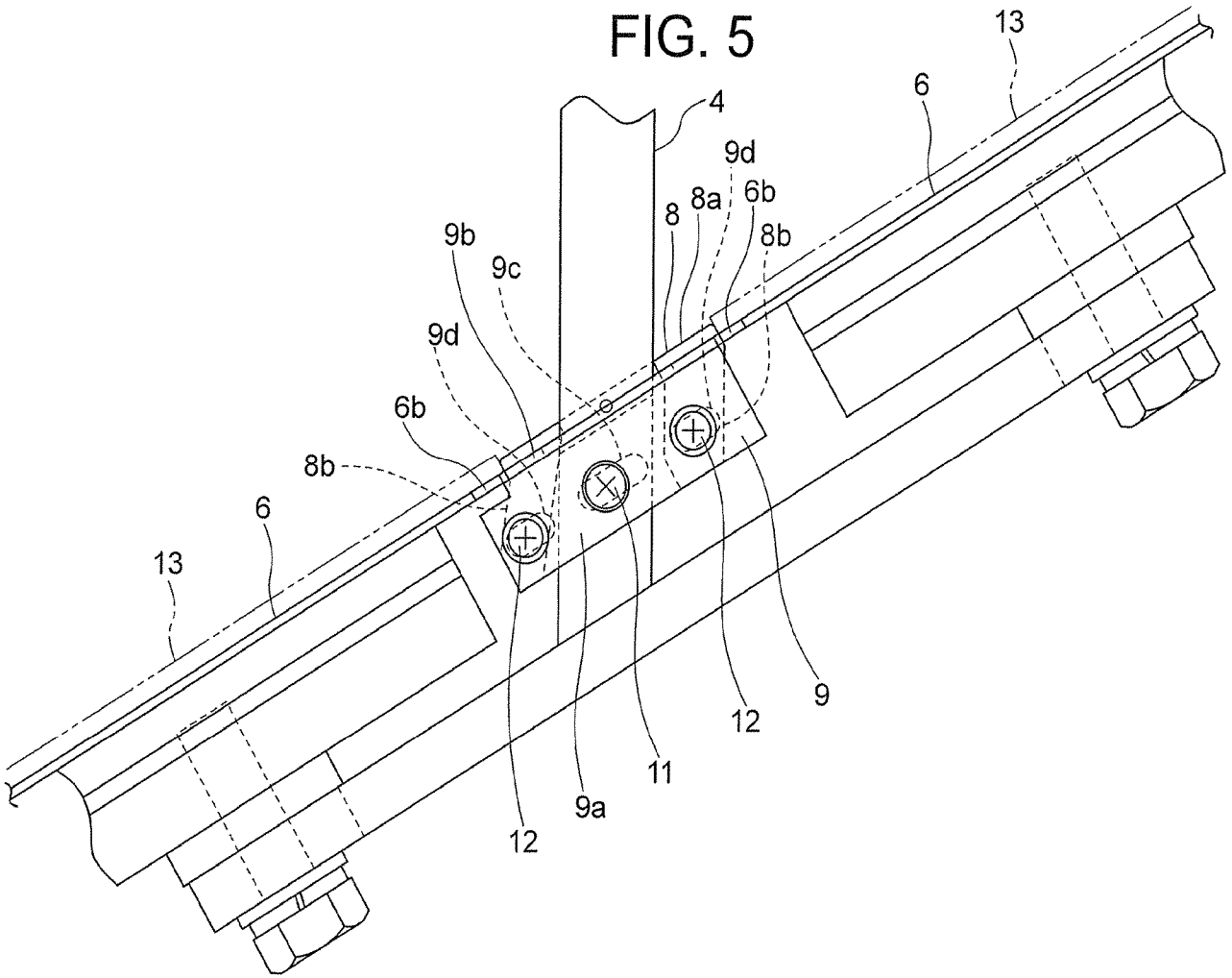
FIG. 5 is a right-side diagram illustrating a joint of the outer decks in FIG. 4.
Figure 6:
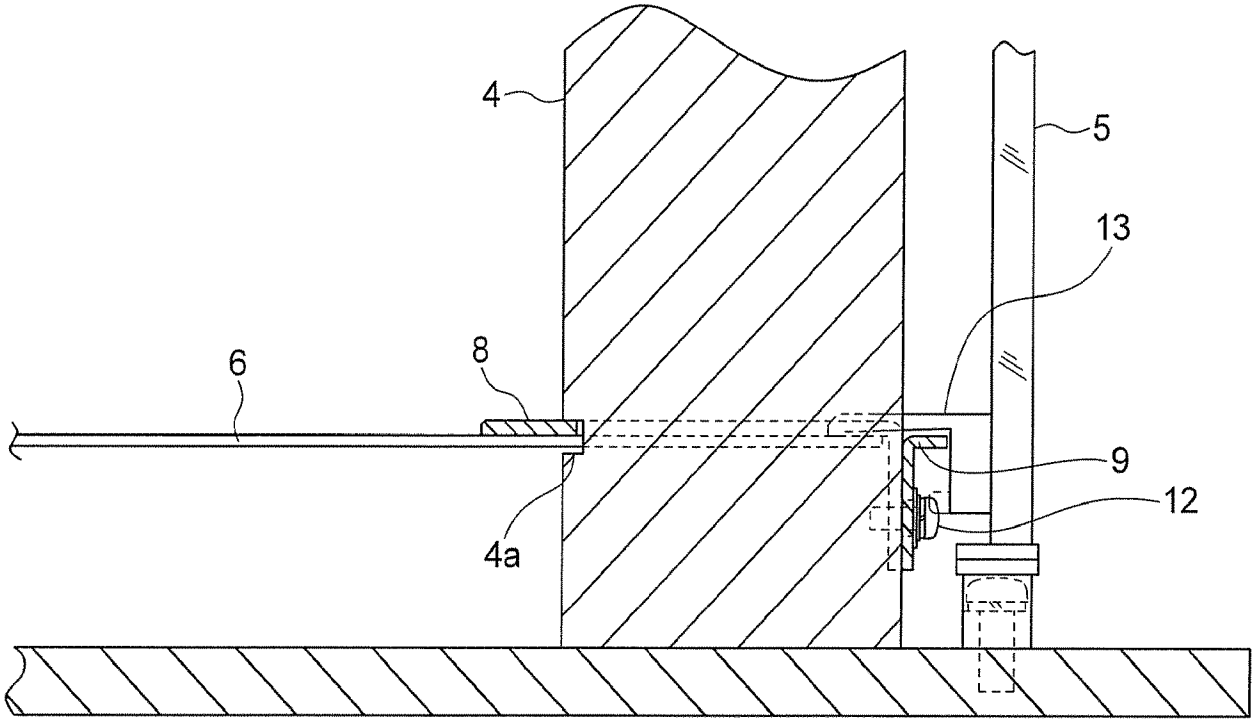
FIG. 6 is a cross-sectional diagram along line VI-VI in FIG. 4.

FIG. 4 is a plan diagram showing a joint of the outer decks 6 in FIG. 1, FIG. 5 is a right-hand side diagram showing a joint of the outer decks 6 in FIG. 4 and FIG. 6 is a cross-sectional diagram along line VI-VI in FIG. 4. By combining the balustrade post notches 6*a* at the mutually adjacent ends of the outer decks 6, a rectangular recess 6*c* is provided passing through the balustrade post 4. A gap 10 (FIG. 12) is provided between the edge of the recess 6*c* and the balustrade post 4.

A cover member 8 which closes the gap 10 is provided on top of the outer decks 6. Each cover member 8 is fixed to the balustrade post 4 via a retainer 9 which is fixed to the step 2-side end face of the balustrade post 4. Each retainer 9 is fixed to the balustrade post 4 by a retainer fixing screw 11. A screw hole into which the retainer fixing screw 11 is fastened is provided in the balustrade post 4.

The cover members 8 are each fixed to the retainer 9 by a pair of cover fasteners 12. Cover fixing screws are used for the cover fasteners 12. The gaps between the outer decks 6, the cover members 8 and the balustrade panels 5 are covered with a packing member 13 made from soft resin, or the like. The packing member 13 is attached after installing the outer decks 6 and the cover members 8 and before installing the balustrade panels 5. As illustrated in FIG. 4, this packing member 13 is cut so as to match the end faces of the balustrade post 4 and the cover member 8, and covers the cover notch 6*b* in the outer deck 6.

Figure 7:
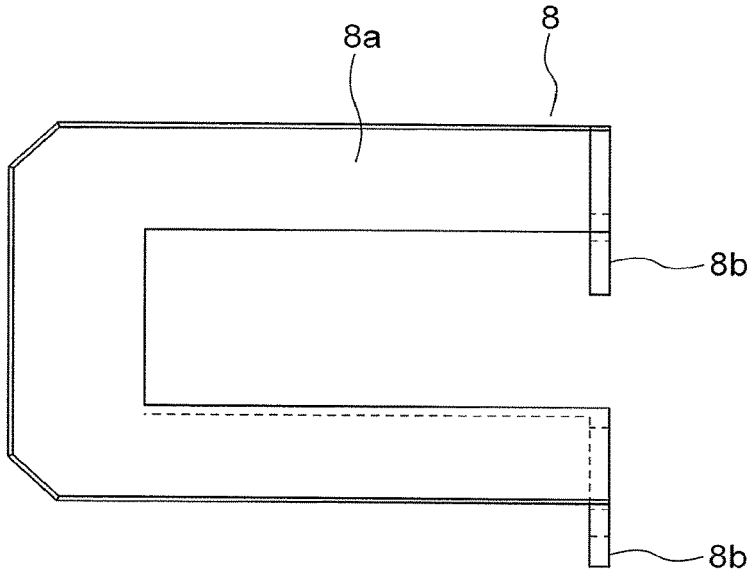
FIG. 7 is a plan diagram showing the cover member in FIG. 4.
Figure 8:
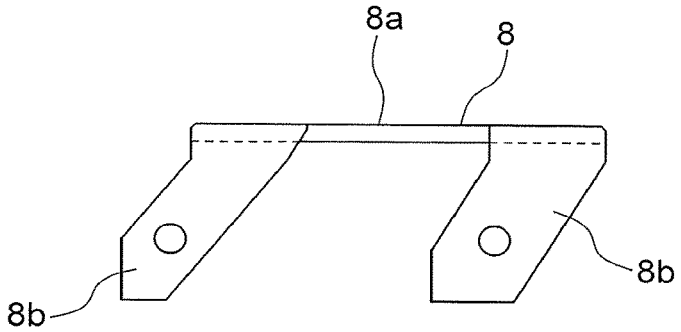
FIG. 8 is a right-side diagram showing the cover member in FIG. 7.
Figure 9:
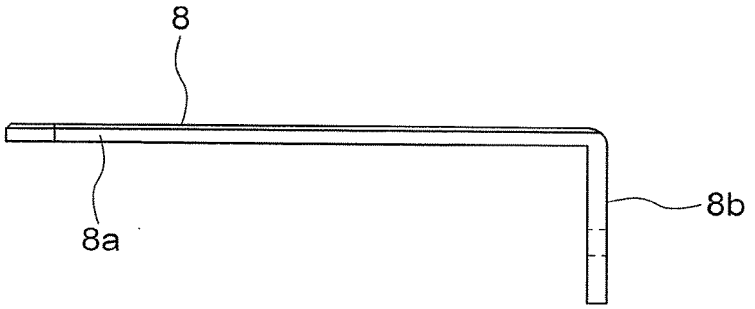
FIG. 9 is a front surface diagram showing the cover member in FIG. 7.

FIG. 7 is a plan diagram illustrating the cover member 8 in FIG. 4, FIG. 8 is a right-side diagram illustrating the cover member 8 in FIG. 7 and FIG. 9 is a front surface diagram illustrating the cover member 8 in FIG. 7. Each cover member 8 includes a U-shaped cover main body 8*a* which is superposed on the outer deck 6 and closes the gap 10, and a pair of cover fixing sections 8*b* which project downwards from the ends of the cover main body 8*a* on the side of the step 2. The cover fixing sections 8*b* are superposed on the opposite side of the retainer 9 from the step 2, and are fixed to the retainer 9 via cover fasteners 12.

Figure 10:
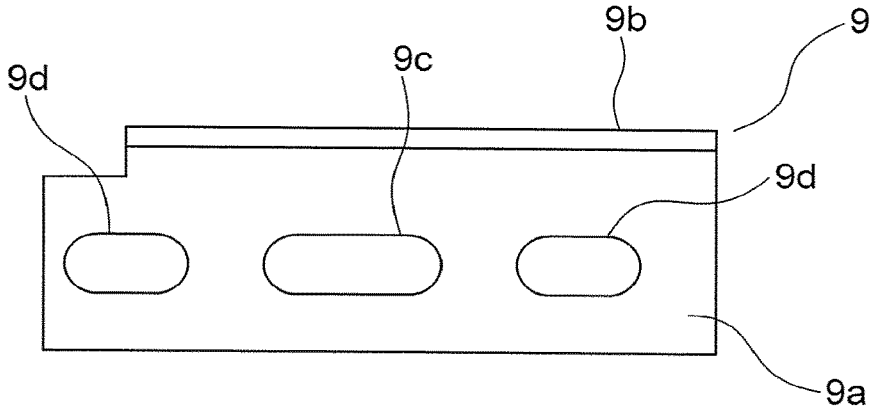
FIG. 10 is a front surface diagram showing the retainer in FIG. 4.
Figure 11:
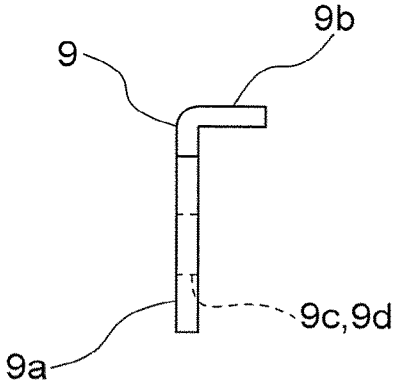
FIG. 11 is a left-side diagram showing the retainer in FIG. 10.

FIG. 10 is a front surface diagram illustrating the retainer 9 in FIG. 4 (as viewed from the side of the step 2), and FIG. 11 is a left-side diagram illustrating the retainer 9 in FIG. 10. The retainer 9 includes a flat plate-shaped retainer main body 9*a* and a bend section 9*b* which projects perpendicularly towards the step 2 from the upper end of the retainer main body 9*a*. A slot 9*c* for a retainer fixing screw is formed in the retainer main body 9*a* in order to pass a retainer fixing screw 11. Consequently, the position at which the retainer 9 is fixed on the balustrade post 4 can be adjusted in the direction of travel of the steps 2.

Furthermore, a pair of fastener slots 9*d* are provided on both sides of the slot 9*c* for a retainer fixing screw in the retainer main body 9*a*, in order to pass cover fasteners 12. Consequently, the position at which the cover member 8 is fixed on the retainer 9 can be adjusted in the direction of travel of the steps 2.

As illustrated in FIG. 6, a rise-up prevention groove 4*a* into which the cover main body 8*a* is inserted, thereby preventing the rising up of the cover member 8, is provided in the end surface of the balustrade post 4 on the opposite side from the step 2. Rising up of the cover main body 8*a* from the outer deck 6 is prevented by the edge of the cover main body 8*a* catching on the rise-up prevention groove 4*a*.

Figure 12:
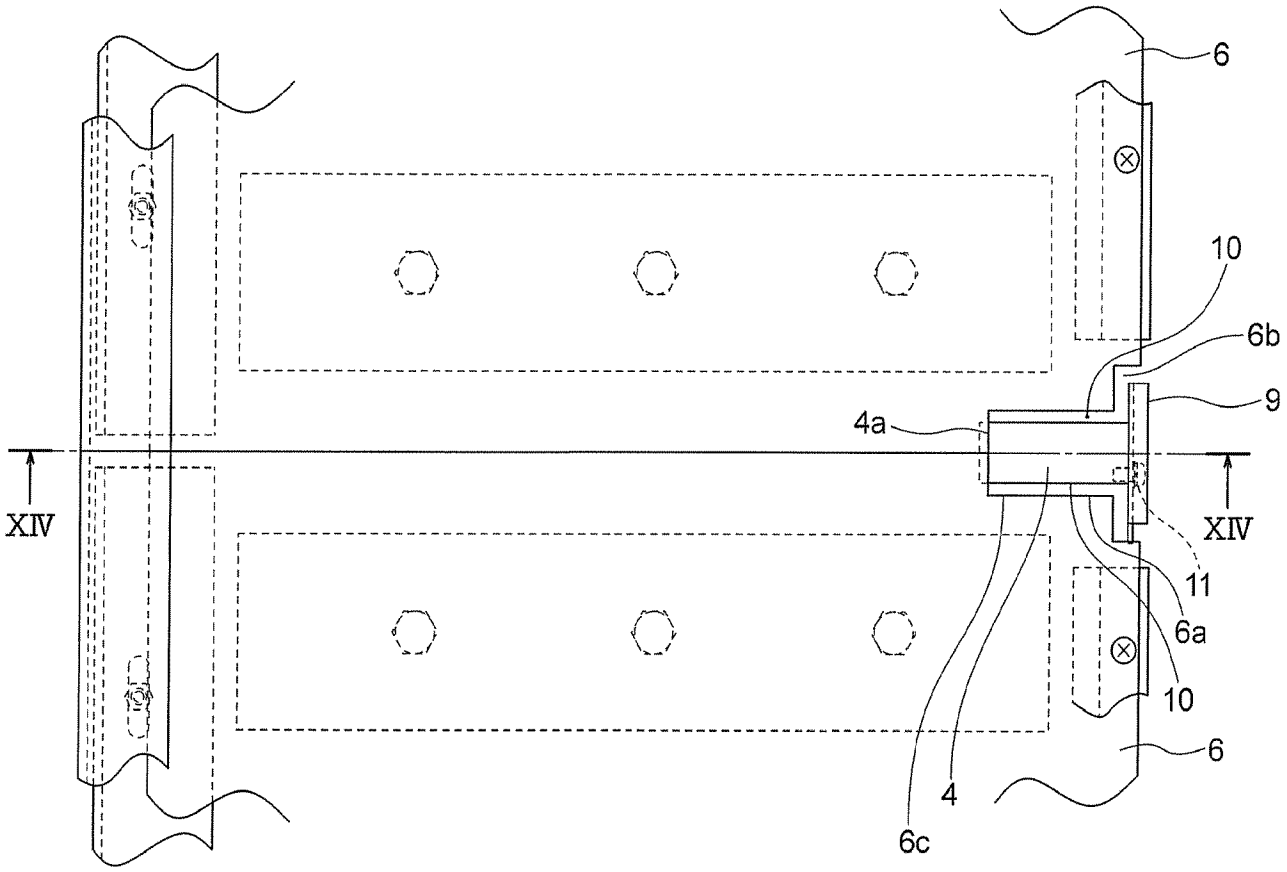
FIG. 12 is a plan diagram illustrating a state before attachment of the cover member on the balustrade device of FIG. 4.
Figure 13:
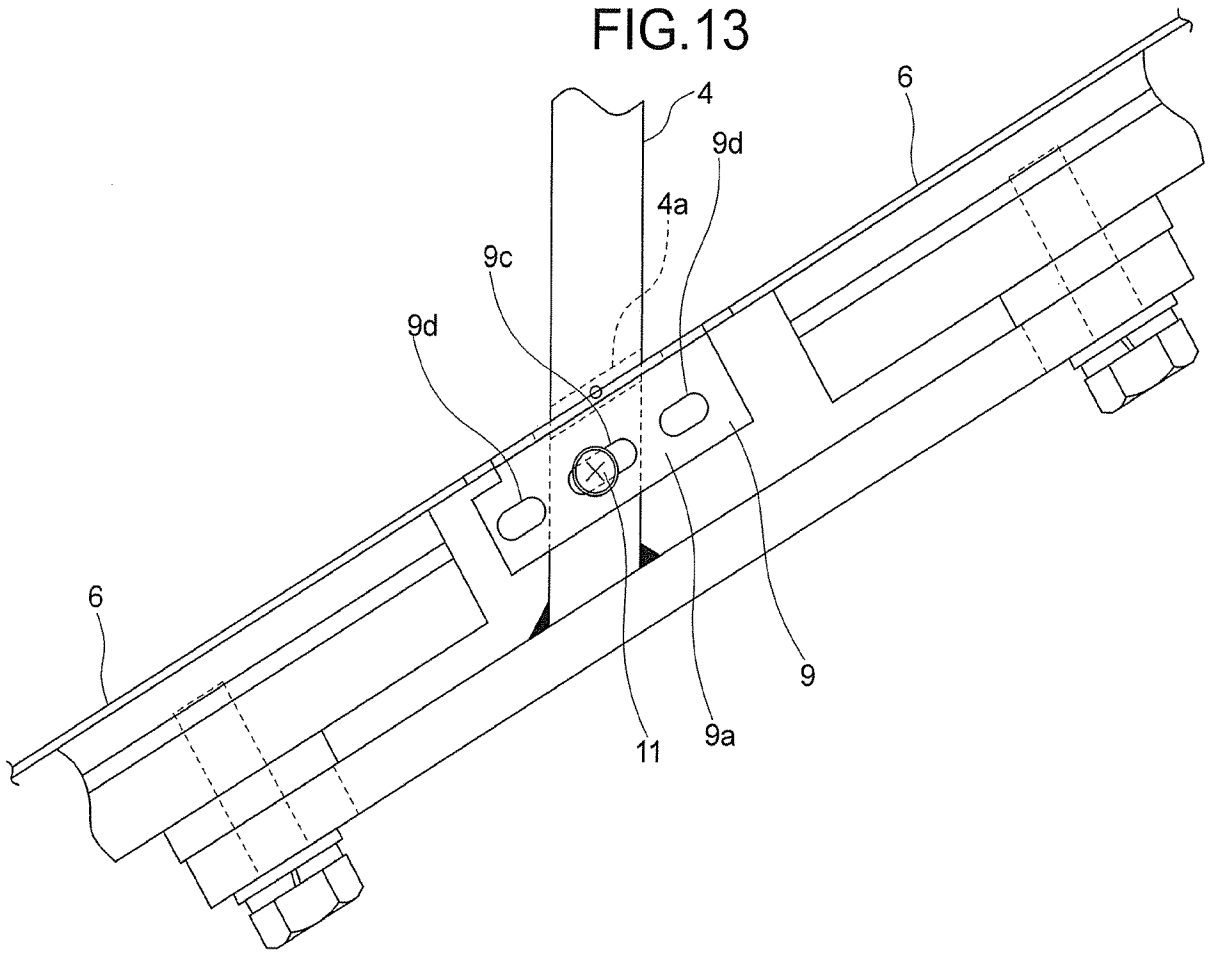
FIG. 13 is a right-side diagram illustrating a joint of the outer decks in FIG. 12.
Figure 14:
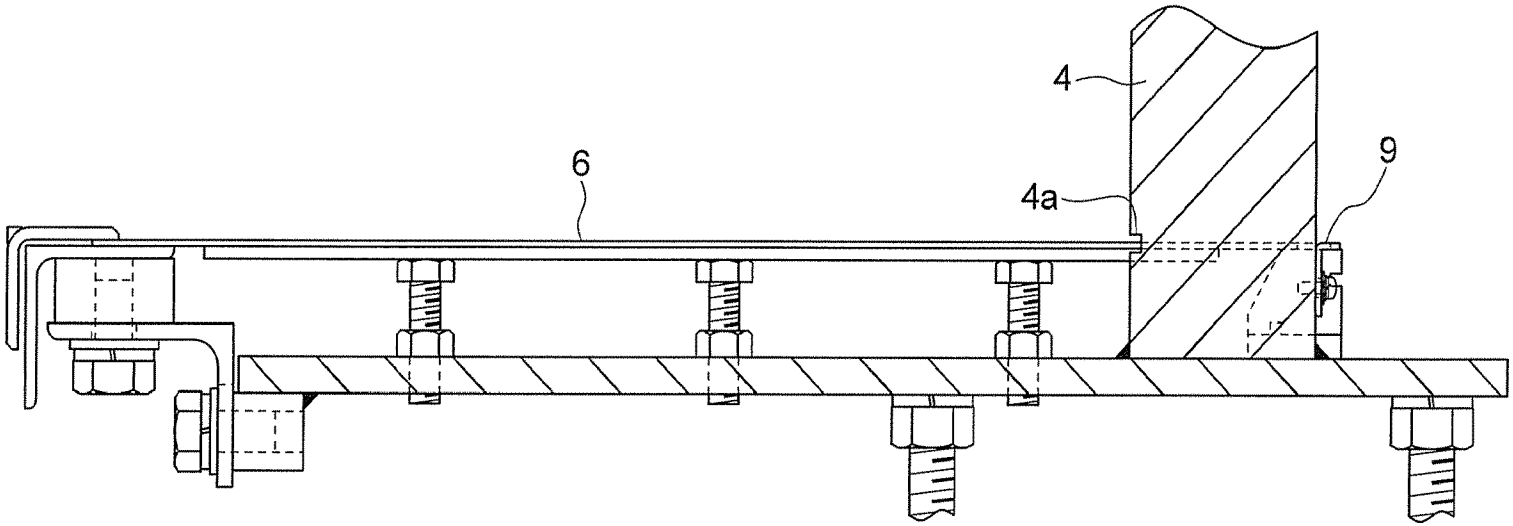
FIG. 14 is a cross-sectional diagram along line XIV-XIV in FIG. 12.

FIG. 12 is a plan diagram illustrating a state before attachment of the cover member 8 on the balustrade device 3 in FIG. 4, FIG. 13 is a right-side diagram illustrating a joint of the outer decks 6 in FIG. 12, and FIG. 14 is a cross-sectional diagram along line XIV-XIV in FIG. 12. As can be seen from these diagrams, after installation of the outer decks 6, the cover member 8 can be fitted into the rise-up prevention groove 4*a* which is provided on the side of the balustrade post 4 opposite to the step 2, and furthermore can be fixed to the balustrade post 4 via the retainer 9, from the side of the step 2.

Figure 15:
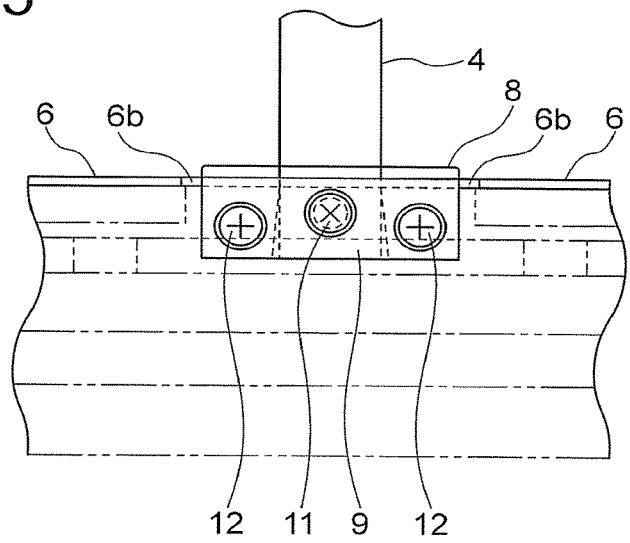
FIG. 15 is a side view diagram illustrating a joint of the outer decks in a horizontal section of the spiral escalator in FIG. 1.
Figure 16:
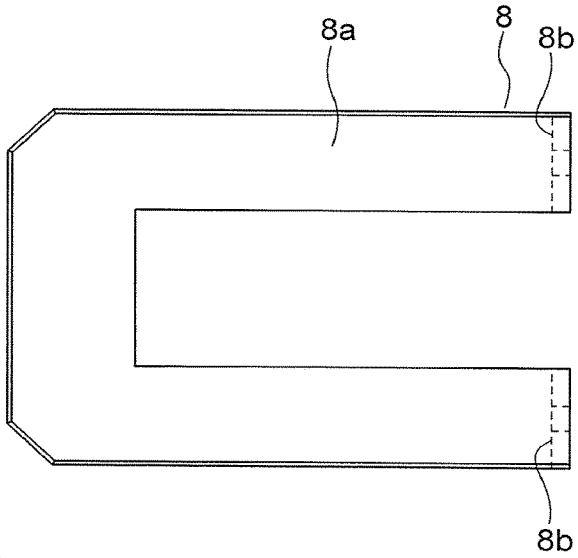
FIG. 16 is a plan diagram showing the cover member in FIG. 15.
Figure 17:
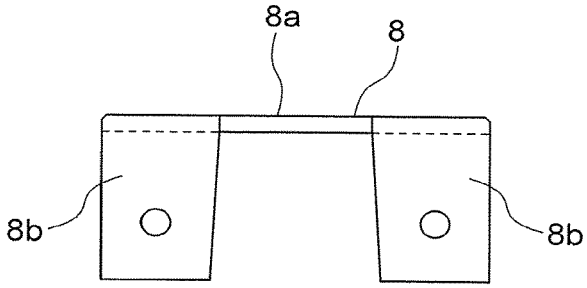
FIG. 17 is a right-side diagram showing the cover member in FIG. 16.
Figure 18:
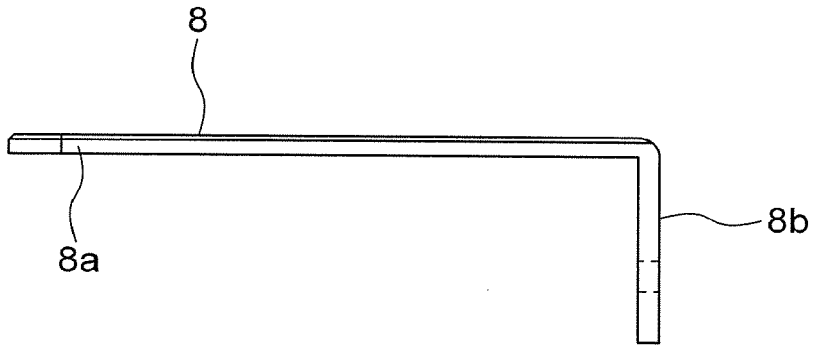
FIG. 18 is a front surface diagram illustrating the cover member in FIG. 16.

FIG. 15 is a side view diagram illustrating a joint between outer decks 6 in a horizontal section of the spiral escalator in FIG. 1 (an upper horizontal section or a lower horizontal section), FIG. 16 is a plan diagram illustrating the cover member 8 in FIG. 15, FIG. 17 is a right-side diagram illustrating the cover member 8 in FIG. 16 and FIG. 18 is a front surface diagram illustrating the cover member 8 in FIG. 16.

In the inclined section of the spiral escalator, as illustrated in FIGS. 7 and 8, the cover fastener 12 is disposed as close as possible to the retainer fixing screw 11, and therefore the cover fixing sections 8*b* project obliquely downwards from the cover main body 8*a*, but in the horizontal section, a cover member 8 having cover fixing sections 8*b* that project vertically downwards from the cover main body 8*a* is used. The shape of the cover member 8 in the horizontal section differs from the shape of the cover member 8 in the inclined section, but the same reference numerals are used for the sake of simplicity.

In a spiral escalator of this kind, the cover members 8 are fixed to the balustrade posts 4 via retainers 9 which are fixed to the end surfaces of the balustrade posts 4 on the side of the steps 2, and therefore the structure of the cover members 8 can be made simple, and the cover members 8 can be attached after installation of the outer decks 6. Furthermore, the cover members 8 can also be fixed easily to the retainers 9 from the side of the steps 2. Moreover, the cover members 8 can be attached without any shaking thereof.

Furthermore, since a gap 10 is provided between the edge of the recess 6*c* in each of the outer decks 6 and the balustrade post 4, and the gap 10 is closed by the cover member 8, then dimensional error between the length between balustrade posts 4 and the length of the corresponding outer deck 6 can be absorbed by the gap 10, and hence the ease of installation of the outer decks 6 can be improved, while preventing any deterioration of the design characteristics.

Moreover, since the cover members 8 are inserted into the rise-up prevention grooves 4*a* provided in the balustrade posts 4, then it is possible to prevent rising up of the cover members 8, by a simple configuration, and the cover members 8 can be attached with even less shaking thereof.

Moreover, since the retainers 9 are fixed to the balustrade posts 4 by retainer fixing screws 11, and a slot 9*c* for a retainer fixing screw is provided in each of the retainers 9, then it is possible to fix the retainers 9 easily to the balustrade posts 4, as well as being able to readily adjust the position of the retainer 9.

Furthermore, since each of the cover members 8 is fixed to a retainer 9 by the cover fixing sections 8*b* which project downwards from the step 2-side end of the cover main body 8*a*, then it is possible to fix the cover member 8 to the retainer 9 easily from the side of the step 2, while preventing deterioration of the design properties.

Moreover, since a pair of cover fixing sections 8*b* are provided on the cover member 8, then the cover member 8 can be fixed securely to the retainer 9 in a state of gripping the balustrade post 4.

The cover members may be arranged throughout the whole width direction of the outer decks, so as to cover the whole of the joints between outer decks.

Furthermore, the number of retainer fixing screws and fasteners for cover fixing is not limited in particular.

Moreover, provided that the cover member can be fixed securely to the retainer, it is possible to use just one cover fixing section.

Moreover, in the example given above, a rise-up prevention groove 4*a* is provided in each of the balustrade posts 4 in order to prevent rising up of the cover member 8, but the rise-up prevention groove 4*a* may be omitted. Furthermore, a protrusion for preventing rising up may be provided in the balustrade post 4, and the edge of the cover member 8 may be caused to catch on this protrusion.

Furthermore, the example given above relates to a spiral escalator, but this invention can also be applied to a normal linear escalator.

Moreover, this invention can also be applied to a walkway which moves in a horizontal or inclined fashion.

The invention claimed is:

1. A balustrade device for a passenger conveyor, comprising:

a plurality of balustrade posts which are erected at intervals apart in a direction of travel of steps; and a plurality of outer decks which are arranged in line with the direction of travel of the steps and abut against each other at positions of the balustrade posts, wherein recesses, through which the balustrade posts are passed respectively, are provided in mutually adjacent end portions of the outer decks;

gaps are provided respectively between edges of the recesses and the balustrade posts;

a plurality of cover members which close the gaps are provided on top of the outer decks; and each of the cover members is fixed to the balustrade post via a retainer that is fixed to an end surface of the balustrade post on a side of the step.

2. The balustrade device for a passenger conveyor according to claim 1, wherein a rise-up prevention groove which prevents rising up of the cover member due to the cover member being inserted therein is provided on the end surface of at least one of the balustrade posts on a side opposite to the step.

3. The balustrade device for a passenger conveyor according to claim 2, wherein the retainer is fixed to the balustrade post by a retainer fixing screw; and a slot for a retainer fixing screw through which the retainer fixing screw is passed is provided in the retainer.

4. The balustrade device for a passenger conveyor according to claim 3, wherein the cover member includes a cover main body which is superposed on the outer deck and closes the gap, and a cover fixing section which projects downwards from an end portion of the cover main body on a side of the step; and the cover fixing section is superposed on the retainer and is fixed to the retainer via a cover fastener.

5. The balustrade device for a passenger conveyor according to claim 1, wherein the retainer is fixed to the balustrade post by a retainer fixing screw; and a slot for a retainer fixing screw through which the retainer fixing screw is passed is provided in the retainer.

6. The balustrade device for a passenger conveyor according to claim 5, wherein the cover member includes a cover main body which is superposed on the outer deck and closes the gap, and a cover fixing section which projects downwards from an end portion of the cover main body on a side of the step; and the cover fixing section is superposed on the retainer and is fixed to the retainer via a cover fastener.

* * * * *